US005511899A

United States Patent [19]

Pavelek, II

[11] Patent Number: 5,511,899

[45] Date of Patent: Apr. 30, 1996

[54] LIGHT DUTY ROADWAY SURFACE FROM RECYCLED WASTE ASPHALT ROOFING SHINGLE MATERIALS

[75] Inventor: Michael D. Pavelek, II, Hershey, Pa.

[73] Assignee: Greater Lebanon Refuse Authority, Lebanon, Pa.

[21] Appl. No.: 382,913

[22] Filed: Feb. 3, 1995

[51] Int. Cl.[6] ..... E01C 7/26

[52] U.S. Cl. ..... 404/31; 404/32; 404/44; 404/82

[58] Field of Search ..... 404/31, 32, 44, 404/82

[56] References Cited

U.S. PATENT DOCUMENTS

| | | | |
|---|---|---|---|
| 3,969,851 | 7/1976 | Whitacre | 404/82 X |
| 4,325,641 | 4/1982 | Babus et al. | 366/18 |
| 4,330,340 | 5/1982 | Carlton | 106/28 |
| 4,706,893 | 11/1987 | Brock | 241/23 |
| 4,726,846 | 2/1988 | Jackson et al. | 106/281 R |
| 5,098,025 | 3/1992 | Drovin et al. | 241/21 |
| 5,173,115 | 12/1992 | Glynn, Jr. et al. | 106/281.1 |
| 5,201,472 | 4/1993 | Brock | 241/22 |
| 5,221,338 | 6/1993 | Gaudio et al. | 106/282 |
| 5,223,032 | 6/1993 | Gaudio et al. | 106/282 |
| 5,236,497 | 8/1993 | Grzybowski | 106/282 |
| 5,242,493 | 9/1993 | Glynn, Jr. et al. | 106/277 |
| 5,385,426 | 1/1995 | Omann | 404/75 |

*Primary Examiner*—William P. Neuder
*Attorney, Agent, or Firm*—Eckert Seamans Cherin & Mellott

[57] ABSTRACT

A roadway surface for private driveways, rural roads and farm lanes or other light traffic surfaces is made from recycled asphalt roofing shingles in pieces, preferably elongated strips, that overlie one another to form a cushioning mat. The roadway surface has a base layer of crushed aggregate such as paving stone, gravel or dirt, over which is a middle layer of shredded or particulated asphalt roofing shingle waste materials, such as reclaimed used asphalt roofing shingles and optionally new shingle tabs or other shingle production waste. The binding characteristics of the shingle pieces can be enhanced by adding a petroleum distillate such as asphalt, bitumen, paraffin, or tar. A top dressing layer of crushed aggregate such as paving stone or gravel protects and isolates the cushioning mat of shingle pieces. Each layer can be applied using conventional roadway grading equipment, preferably in layers of about one to two inches thick. The roadway surface from recycled asphalt shingle materials solves problems associated with dirt or paving stone roadways and also reduces the volume of asphalt roofing shingle wastes to be disposed of in landfills.

18 Claims, 2 Drawing Sheets

PRIOR ART

INVENTION

LIGHT DUTY ROADWAY SURFACE FROM RECYCLED WASTE ASPHALT ROOFING SHINGLE MATERIALS

FIELD OF THE INVENTION

The invention relates to roadway surfaces, especially for light traffic areas such as farm lanes. rural roads, driveways and the like, and to methods for construction of such light duty roadway surfaces. More specifically, the invention employs reclaimed and recycled waste asphalt roofing shingle materials in a method of construction of roadway surfaces that, among other things, minimizes dusting and noise, resists grooving from traffic and erosion. is water permeable, and absorbs fuel and oil.

BACKGROUND OF THE INVENTION

Roadway surfaces are made from various combinations of aggregate particles and binders. Light duty roadway surfaces, typically made of dirt, gravel and/or stone, are useful for rural roads, farm lanes, private driveways and other situations but often lack binders. For such roadways, the expected volume of traffic is relatively low and it is unreasonable to invest in a black top or concrete roadway surface, which would be quite substantially more expensive. However, conventional light duty roadway surfaces have a number of problems. It would be advantageous if an inexpensive surfacing technique could provide some of the advantages of the expensive ones, such as long term durability, resistance to water damage (especially from freeze/thaw cycles), minimal generation of dust, and smoothness.

Vehicles moving over stone, gravel and similar surfaces cause a stone crushing effect from the grinding together of stones and/or stone particles. This produces dust, some of which remains in the roadway surface, and some of which becomes airborne under the influence of wind or passing vehicles. Airborne dust particles reduce visibility and increase the risk of accidents. Airborne dust creates a nuisance by settling on vehicles homes. people. and anything else in the area of the roadway. The dust is also abrasive and wears vehicle paint. Insofar as dust remains in the roadway, erosion from water is a problem.

Light duty surfaces are not particularly smooth. They develop wheel ruts from traffic and water. Rain, ice and traffic cause potholes. Grading and similar periodic maintenance is needed to keep the surface level or properly crowned, and perhaps to introduce an agent to keep down dust. The deterioration of the surface eventually requires reconstruction or resurfacing.

Moreover, such surfaces generate substantial noise. They are permeable to fuels and oils that leak from vehicles, which may result in the contamination of underground aquifers and surface waters. These and other drawbacks of conventional light duty, low cost surfacing techniques must be balanced against the added cost of the more durable surfaces that are used on more heavily travelled roads and highways.

According to the present invention, a low cost roadway is improved by including strips and particles of preferably-recycled asphalt roofing shingles. The accumulation of waste material in the nation's landfills is a major problem in general, and waste roofing materials in particular are a bulky and heavy form of waste. Asphalt roofing shingle waste is generated, for example, in the manufacture of new shingles, with broken and defective shingles, cutouts, trimmings, and tabs being discarded. Used shingles are frequently discarded when reshingling a roof.

The United States presently produces between 70 and 80 million "squares" of roofing shingles each year, each square representing a quantity of shingles sufficient to cover an area of 100 square feet and weighing between 210 and 235 pounds. Over about the last decade, the construction of shingles has changed. Shingles made before 1980 typically contained. by weight, 50 to 55% asphalt, with the remainder comprising felt or paper reinforcing mat, surface granules, filler, and backing materials. Shingles made after 1980 typically contain, by weight, about 20 to 30% asphalt with the remainder fiberglass reinforcing mat. roofing granules, filler, and backing materials.

A significant portion of asphalt roofing shingle waste is from removal of used shingles. New shingles are flexible and somewhat tacky. After years of exposure, the shingles become brittle and weathered, and are unsuitable for their original purpose. An estimated 60% of the roofing shingles produced go into new construction, and about 40% are used to replace old construction. Thus, a volume of old shingles discarded annually is equal to roughly 40% of the annual production of new shingles—about 20 to 32 million squares or about 2,100,000 to 3,360,000 tons of discarded waste material.

Additionally, a significant volume of associated production waste is generated during the manufacture of roofing shingles. The production of standard three-tab shingles generates cut-outs and trimmings, otherwise known as shingle tabs, that amount to nearly 1% of the weight of a shingle. Hence, even ignoring the volume of broken and defective shingles generated, shingle production results annually in approximately 73,500 to 94,000 tons of waste material containing about 14,700 to 28,200 tons of asphalt.

Traditionally, reclaimed roofing shingle wastes and shingle tabs are discarded into landfills. Asphalt roofing shingles and associated production wastes degrade very slowly, particularly when not exposed to weathering. They accumulate in landfills. Alternative means for disposing of roofing shingles and associated production wastes are needed.

Several attempts to recycle roofing shingle wastes are suggested in the U.S. patent literature. U.S. Pat. Nos. 5,221,338 and 5,223,032 (both Gaudio, et al.) teach the construction. repair and maintenance of asphalt-containing products using asphalt refuse, including roofing shingles. The method includes comminuting reclaimed asphalt shingles to a small particle size; combining the comminuted asphalt shingles with comminuted roughage such as crushed concrete, crushed asphalt pavement, sand and/or stone, and fibrous materials. to form a cold mix of particulated asphalt shingles without heating the asphalt into a liquified state; adding a solvent to the mixture, such as a water-based solvent or oil-based solvent that lubricates, softens, reconditions and/or rejuvenates the recycled asphalt product. The resultant product is a cold mix composition used for repairing, maintaining or constructing asphalt-containing particles, particularly roadway pavement. However. this is accomplished substantially by converting the structure of the shingles into a mix of small aggregate particles in a binder of asphalt. The cold mix is conformable to any pothole or other configuration, i.e., it is workable with a shovel.

A similar approach dealing with roofing shingle wastes is disclosed in U.S. Pat. No. 5,236,497 (Grzybowski). This an reference teaches preparing a similar cold patch composition for pavement repair including the steps of: mixing together recycled asphalt roofing shingles, as a source of asphalt, filler and fiber, with aggregate such as crushed stone, and solvent such as petroleum distillates, without heating, to form a cold patch pavement repair composition that can be worked to conform to the shape of a pothole or the like.

Other patents focus on heat utilizing processes. U.S. Pat. Nos. 4,325,641 (Bobus, et al.) and 4,706,893 (Brock '893) teach methods of recycling asphalt waste shingle tabs or asphalt waste roofing shingles by heating such materials and incorporating them into liquified asphalt paving compositions. Generally, these U.S. patents involve heating of the roofing shingle wastes to melt the asphalt therein and mixing therewith, a certain amount of virgin asphalt and crushed stone or aggregate to form a suitable roadway construction composition.

Still another patent teaches an improvement on the method disclosed in Brock '893. U.S. Pat. No. 5,201,472 (Brock '472) treats asphalt roofing shingles to form a recyclable asphalt material which can be stored, transported, and later used as a component of an asphalt paving composition. Brock '893 teaches that comminuted shingle material must be used quickly after being shredded because the shredded shingle material adheres together after a period of time. After long periods, adverse effects occur on the flowability of the shredded shingle materials and on metering the materials into a recycled mix. Thus. Brock '472 is more particularly directed to a method of storing recyclable shingle materials for extended periods of time without adverse effects on flowability. Particularly, Brock '472 teaches the combining of shredded shingle material with aggregate at a temperature below the melting point temperature of asphalt. According to Brock '472, the resultant mixture of comminuted shingles and aggregate may then be stored prior to recycling into an asphalt-aggregate paving composition without significant agglomeration.

The foregoing attempts to recycle asphalt shingles have in common the aspect that the resulting product is formless, being liquid, or consisting of flowable particles. According to the present invention, a useful product for paving is produced by taking advantage of the form of the recycled materials rather than turning them into a formless moldable composition.

An economical light duty roadway surface, especially for private driveways, farm lanes, and rural roads or other light traffic surfaces, that is simple and cost effective to construct, durable, and reduces the inherent problems of dust and noise associated with conventional dirt. stone and gravel roads. This is accomplished according to the invention by dividing shingle material into strips and using a plurality of the strips to form a layer of roadway wherein the strips overlie one another to provide a form of porous shingle material mat or sheet.

SUMMARY OF THE INVENTION

It is an object of the present invention to provide a light duty roadway surface from waste asphalt roofing shingle materials.

It is another object of the invention to provide a light duty roadway surface from waste asphalt roofing shingle materials which reduces noise levels and/or raised dust levels over a conventional paving stone or dirt light duty roadway surface.

It is still another object of the invention to provide a light duty roadway surface from waste asphalt roofing shingle materials which resists erosion and grooving.

It is still another object of the invention to provide a light duty roadway surface from waste asphalt roofing shingle materials which acts as a barrier or filter to absorb discharged fuels or oils, thereby preventing leaching of the fuels or oils into the underlying soil and ground water supply.

It is yet another object of the invention to provide a light duty roadway surface comprising one or more alternating layers. One layer comprises shredded waste roofing shingle material, preferably in the form of overlying strips. An adjacent layer comprises crushed paving stone. Preferably a layer of shredded waste roofing shingle material is sandwiched between two adjacent layers of paving stone. More preferably, a one to two inch layer of shredded roofing shingle material in overlying strips is sandwiched between two one to two inch layers of paving stone.

The strips of shingle material have a reduced tendency to solidify into a mass, as compared to formless cold mix compositions, but tend to bind with one another sufficiently to form a mat or sheet-like supporting layer with better structural integrity than an aggregate lacking any binder. The strips can be handled using the same type of equipment that might be used to construct and maintain a conventional light duty roadway surface, e.g., dumping, grading, rolling and similar equipment.

According to an inventive aspect, a light duty roadway surface is composed of an alternating layer(s) of waste asphalt roofing shingle material, preferably reclaimed used roofing shingles, reduced in size to form strips, chips and the like that generally retain their shape as in the shingles, i.e., flat chips or strips. The shingle layer has a plurality of overlying pieces, and is alternated with adjacent layer(s) of crushed aggregate, preferably paving stone. The number and thickness of the alternating layers may vary depending on the traffic needs associated with a particular application. Hydrocarbon distillate, such as asphalt. paraffin, bitumen, tar, or the like can be added, to rejuvenate the asphalt contained in the shredded roofing shingle material used in the construction of the roadway surface and to more intimately adhere the shingle pieces. Production waste shingle tabs (i.e., pieces of unused shingle material) can be mixed into the layer of reclaimed used asphalt roofing shingle pieces, to provide enhanced kneadability and to better bind the shingle piece layer of the roadway, due to their higher content of still flexible and tacky asphalt as compared to the pieces of reclaimed used roofing shingles.

According to another aspect, a method of constructing the light duty roadway surface of having a shingle piece layer and layer(s) of stone or the like, uses the same type of equipment as used to construct conventional light duty roadway surfaces. The method can include size reducing the asphalt roofing shingle material, preferably by shredding into elongated strips of a size that can be graded into a layer in which the strips overlie one another; optionally, purifying the asphalt roofing shingle material after it is shredded, preferably including magnetic action to remove any ferrous material, especially nails; and, applying in facing layers at least one layer of crushed aggregate, preferably paving stone, and at least one layer of reduced waste asphalt roofing shingle pieces. The top most layer of the roadway surface advantageously is a layer of crushed aggregate, more preferably aggregate paving stone, to isolate the sticky roofing shingle material from contact with vehicle tires.

The method may optionally include adding a hydrocarbon distillate to the shredded roofing shingle material prior to, or subsequent to, the application of the shingle material at the site of the roadway surface. Production waste shingle tabs can be included in the shredded roofing shingle material prior to application of the shredded waste roofing shingle material at the site.

The resulting light duty roadway surface alleviates a number of problems associated with known light duty roadway surfaces. The roadway is durable and resists rutting due to support from the shingle pieces and the added integrity of their adhesion in the shingle piece layer. Noise is reduced by providing internal cushioning. Dust is reduced because the shingle piece layer is impermeable to dust and resides between a portion of paving stone and the ground. A portion of the paving stones adhere to and in the shingle piece layer, which is somewhat tacky, and reduces stone crushing effects as well as capturing dust. Shock absorption and internal adhesion in the shingle piece layer slow erosion of the roadway surface, and the roadway is made semi-permeable, permitting heavy rains to run off, being tolerant of freeze/thaw cycles, and also absorbing and holding spilled fuel and oil.

The invention can be implemented with the same equipment used to construct conventional light duty roadway surfaces. There is no need to comminute the shingle material extensively to form an aggregate and binder, solvents and heating are not required, and the recycled shingles need not be mixed with crushed aggregate before application to the roadway.

BRIEF DESCRIPTION OF THE DRAWINGS

There are shown in the drawings the embodiments of the invention as presently preferred. It should be understood that the invention is capable of embodiment in a number of specific arrangements in accordance with the disclosure herein, and reference should be made to the appended claims rather than discussion of exemplary embodiments to better access the scope of the invention in which exclusive rights are claimed. In the drawings:

DETAILED DESCRIPTION OF THE PREFERRED EMBODIMENTS OF THE INVENTION

The invention provides a superior light duty roadway surface and a method of constructing the same, using the beneficial properties of pieces of shingle material, such as fiat elongated strips. formed into a paving layer of overlying pieces. The roadway surface costs about the same to construct as a conventional light duty roadway surface, but significantly less than blacktop or concrete surfaces, and requires reduced maintenance as compared to conventional surfaces. However, the roadway can be built using the same equipment that is used conventionally to construct loose stone roadways. The invention solves concerns associated with roadway quality, construction and maintenance, as well as concerns associated with disposal of waste asphalt shingle materials in landfills.

Figure 1:
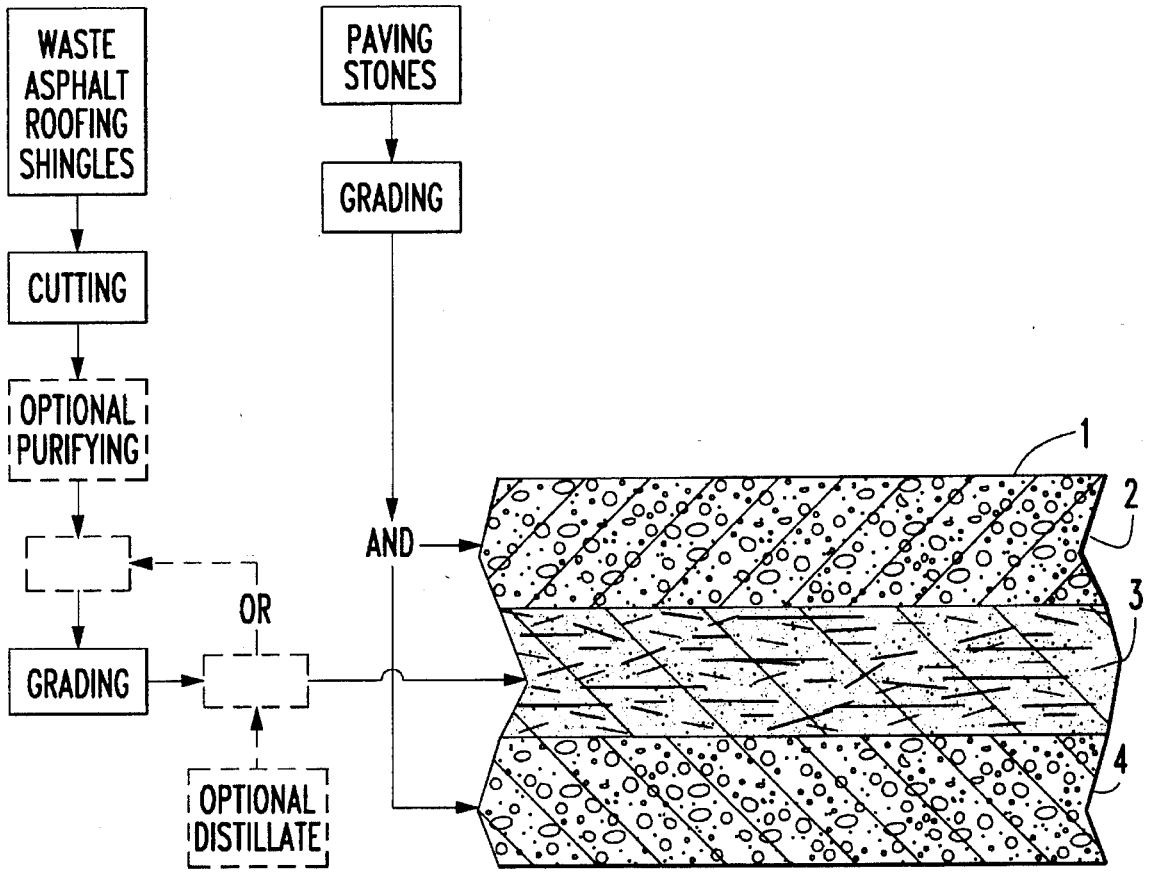
FIG. 1 is a section view through a vertical slice of light duty roadway surface according to the invention, showing the top roadway surface and the underlying layered construction according to a first embodiment.
Figure 2:
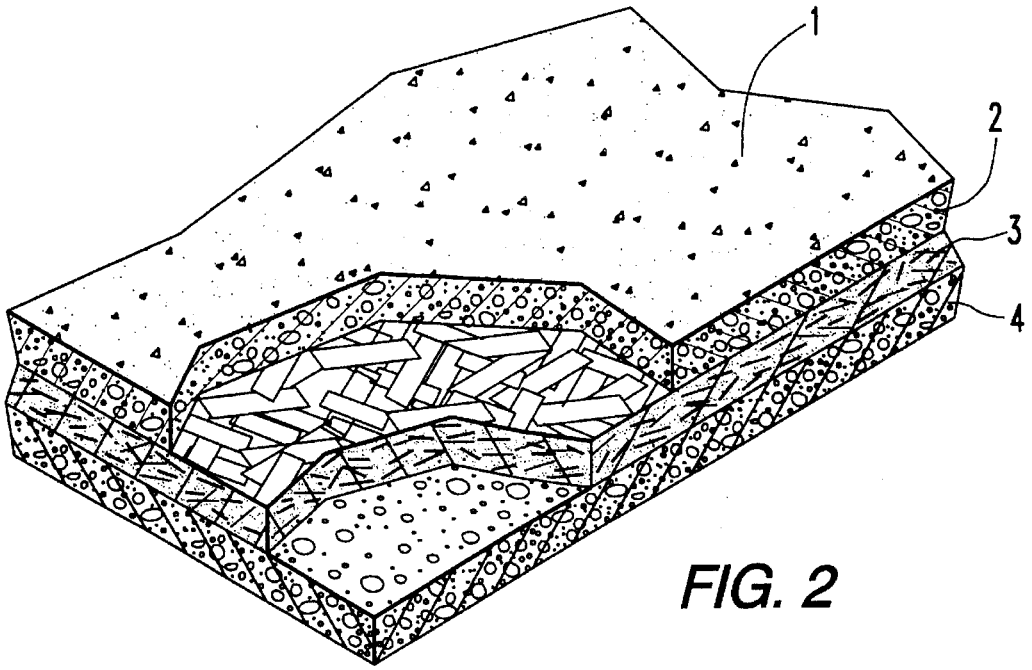
FIG. 2 is a perspective view of an embodiment of the invention showing the upper layers partially cut away; and, FIG. 3 is a dual illustration comparing the dust clouding caused by traffic on a prior art light duty roadway surface (FIG. 3A) with that caused by traffic on the light duty roadway surface of the invention (FIG. 3B).

Preferably, alternating layer(s) of size reduced waste asphalt roofing shingle materials. such as reclaimed used roofing shingles, new production shingle tab waste, or mixtures thereof. are disposed below and/or above crushed aggregate, such as paving stone, gravel, sand, dirt, or mixtures thereof. A preferred embodiment of the roadway surface of the invention is shown generally in FIGS. 1 and 2. The roadway surface 1 includes a dressing or top layer 2 of crushed paving stone; a cushioning-adhesive layer 3 of shredded reclaimed asphalt roofing shingles formed by overlying strips and pieces; and a base or bottom layer 4 of crushed paving stone.

The light duty roadway surface 1 can comprise about a one to two inch base layer 4 of crushed paving stone, covered with about a one to two inch cushioning-adhesive layer 3 of shredded used roofing shingle material, and topped with about a one to two inch dressing layer 2 of crushed paving stone. It should be understood that while Figures I and 2 represent a preferred embodiment in connection with a light duty roadway surface such as a lightly travelled country road, farm road, driveway or the like, other embodiments as described below, or further variations, for example, in the number or sizes of layers or the like, are not excluded.

The dressing or top layer 2 can comprise crushed aggregate, such as paving stone, gravel, sand and dirt, or mixtures thereof and the like. Paving stone is most preferred. The dressing layer 2 can have a thickness of about one to two inches, and provides a barrier between the cushioning-adhesive layer 3 comprised of size reduced asphalt roofing shingle material, and the tires of a passing vehicle. The dressing layer 2 protects layer 3, and also isolates the pieces of shingle material from the tires of vehicles, to which the pieces could adhere.

The cushioning-adhesive layer 3 can comprise used waste asphalt roofing shingle material or new production waste. Most preferably, reclaimed used waste roofing shingles that have been removed from their original application are used. Asphalt roofing shingles typically are composed of asphalt, mineral filler, roofing granules, and backing materials, all reinforced with felt or paper matting. More recently produced shingles may have fiberglass matting for structural integrity. A used shingle removed from its original application typically has deteriorated and become brittle and weathered, generally due to loss of volatile portions of its asphalt (or other hydrocarbon distillate) content, exposure to ultraviolet light and to the elements. However, used roofing shingles retain some structural integrity, particularly if they include a reinforcing mat of felt or fiberglass. Remnants of the original asphalt content, when cut into pieces, preferably overlapping strips, provide a layered structure of any desired thickness, with advantageous structural properties and a tendency to adhere to one another to form a resilient supporting mat.

The cushioning-adhesive layer 3 can also include other asphalt roofing shingle waste materials, such as wastes of new shingle manufacture, for example shingle tabs, cutouts, trimmings, broken or defective shingles, and other shingle manufacture wastes. Pieces of new manufacture asphalt roofing shingle wastes preferably are mixed with reclaimed used wastes in the cushioning-adhesive layer 3. The new manufacture wastes provide additional binder due to their more resilient asphalt content than their used and reclaimed counterparts. Thus the use, for example, of shingle tabs provides enhanced kneadability to the roadway surface of the invention and a more self adhering form to layer 3.

The shingles for cushioning-adhesive layer 3 are preferably size reduced by shredding using conventional techniques for forming elongated strips. The strips overlie one another and can adhere layer 3 into a resilient mass. The strips preferably have a sufficient size suitable for application using conventional roadway surfacing equipment, e.g., dump trucks, graders, rollers, etc. Preferably the strips are about one to six inches in length, about one sixteenth to one half inch in width, and of course the same thickness as the shingles from which the strips are cut. At least a portion of the waste roofing shingles also can be size reduced by particulating by conventional techniques. Particulates of a suitable particle size also can be applied with a conventional roadway surfacing device, but preferably the pieces (e.g., strips) are of a sufficient size to overlie one another for better structural performance. The cushioning-adhesive layer 3 is preferably provided in a thickness of about one to two inches. A thicker layer is also possible, or a thinner layer, provided the pieces are placed thickly enough to engage and adhere to one another, for example six to twenty strip thicknesses. The strips tend to lie flat on one another, although not exclusively, especially if layer 3 is rolled.

Layer 3 serves as a cushion between dressing layer 2 and base layer 4, alleviating some of the stone crushing effect associated with prior art surfaces and consequently reducing the dust creation and noise. The shredded roofing shingle material in the cushioning-adhesive layer 3 with the remaining asphalt content also acts as a binder material to bind with particles in the roadway surface, preventing the bound particles from becoming airborne, and therefore functions to further reduce the amount of airborne dust produced by traffic along the roadway surface. Cushioning-adhesive layer 3 provides the roadway surface with internal elasticity and adhesion that helps to resist spreading from traffic, providing a more stable surface requiring reduced maintenance.

Layer 3 is not only flexible but is semi-permeable to water. Layer 3 can repel heavy water flow. thus providing resistance to erosion. Standing water can pass through, which together with the resilience of layer 3 reduces pothole formation and freeze/thaw damage. Moreover, the shredded roofing shingle material of cushioning-adhesive layer 3 has an affinity for fuel and oil due to its carbonaceous composition. This affinity allows the cushioning-adhesive layer 3 to act as an absorption or filter layer for fuel and oil that may leak onto the roadway. Once absorbed by the cushioning-adhesive layer 3 the fuel and oil leaked onto the surface is held from escaping into the soil or groundwater. This aspect of cushioning-adhesive layer 3 provides protection from soil and water contamination from fuel and oil, that is superior to gravel surfaces, which cannot bind the fuel or oil, and also blacktop and concrete surfaces, that permit it to run off.

The base or bottom layer 4 can be comprised of crushed aggregate, such as paving stone, gravel, sand and dirt. or mixtures thereof and the like, although paving stone is most preferred. The base layer 4 is likewise provided in a thickness of about one to two inches. Base layer 4 smooths the existing ground surface and supports the upper layers.

The method of constructing the roadway surface comprises reducing the size of shingle materials into pieces, preferably elongated strips or other shapes that overlap one another in a mass, and generally lie flat. The pieces can be formed by shredding and particulates can be included, formed by comminuting. The strips and particulates are small enough for easy spreading and grading along the roadway, for example using a tailgate spreader or other roadway grading equipment.

The asphalt roofing shingle pieces can be sorted or otherwise purified of foreign material that may be undesirable. For example, magnets or screens can be used to separate out ferrous containing contaminants, especially nails, from the asphalt roofing shingle material.

In a third step, the size reduced asphalt roofing shingle is applied as a separate layer above and/or below a layer of crushed aggregate such as paving stone, the layers being spread and graded through the use of a tailgate spreader or other roadway grading equipment as above. At least two alternating layers of shredded asphalt roofing shingle material and crushed paving stone, gravel or the like, are spread and graded at the site of the roadway. The layers can also be rolled. The layers are suitable to form a driveway, farm lane. rural road, or any other light traffic area road, path or the like. The roadway surface of the invention is advantageously constructed during warm weather to enhance bonding.

A hydrocarbon distillate such as asphalt, tar, paraffin, bitumen, or the like, also can be added to improve bonding. This material is added in a sufficient amount to the roofing shingle piece material to act as an additional binder material. The distillate can be added either before application of the size reduced asphalt roofing shingle material to the site of the roadway or after such material has been spread and/or graded. The resulting composition provides a roadway surface that will support higher volumes of traffic than a binderless aggregate, and/or requires less maintenance. The addition of a hydrocarbon distillate to the size reduced roofing shingle material, however, will reduce the capacity of the roadway surface for absorbing subsequent fuel and oil leaks.

Figure 3A:
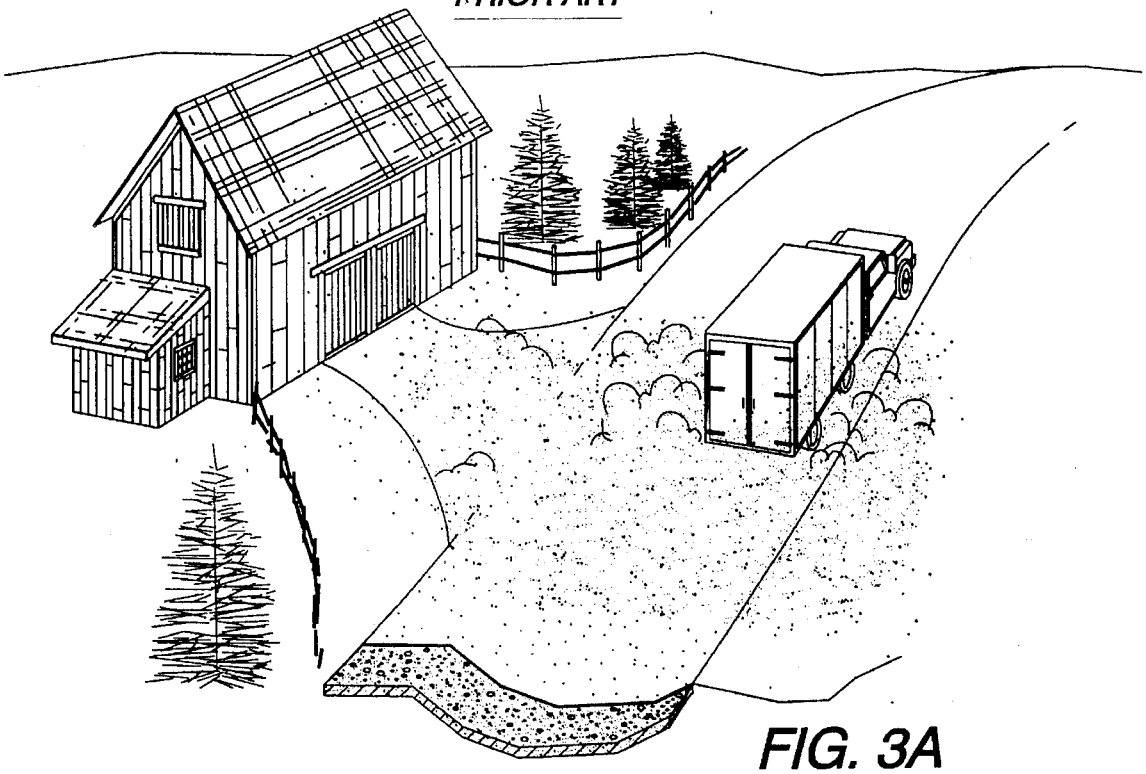
Figure 3B:
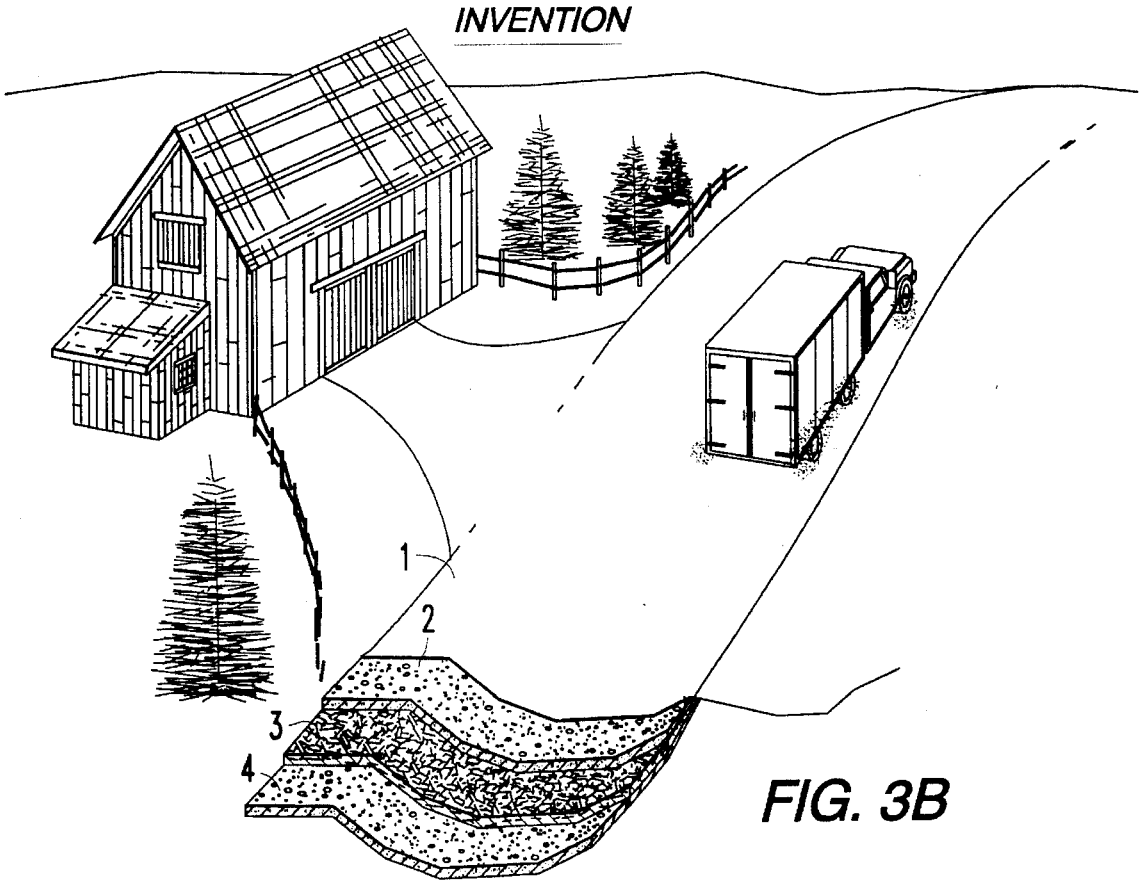

FIG. 3 which includes FIGS. 3A and 3B represents a "before and after" depiction, respectively. The reduced dust generation typical of the light duty roadway surface of the invention is shown. Traffic along a dirt or gravel road generates significant dust as seen in FIG. 3A, which dust is a nuisance and a safety hazard. The roadway surface of the invention substantially reduces the amount of dust that becomes airborne due to traffic, as shown in FIG. 3B.

The invention having been disclosed in connection with the foregoing variations, additional variations will now be apparent to persons skilled in the art. The invention is not intended to be limited to the variations specifically mentioned, and accordingly reference should be made to the appended claims rather than the foregoing discussion of preferred variations, to assess the spirit and scope of the invention in which exclusive rights are claimed.

I claim:

1. A light duty roadway surface, which comprises:

at least two overlying layers, an internal one of the layers comprising size reduced individual pieces of asphalt roofing shingle material overlying one another to form a mat, and another of the layers comprising a loose crushed aggregate, whereby the mat provides internal support and the two layers form a water permeable roadway surface.

2. The light duty roadway surface of claim 1, comprising:

at least three overlying layers, at least one of the layers comprising crushed aggregate, and at least another of the layers comprising size reduced individual pieces of asphalt roofing shingle material overlying one another to form the mat, and wherein the crushed aggregate and the size reduced pieces of asphalt roofing material overlie one another in the layers.

3. The light duty roadway surface of claim 2, wherein the size reduced pieces of asphalt roofing shingle material consist essentially of elongated strips that overlie one another in said layer thereof.

4. The light duty roadway surface of claim 2, wherein the layer comprising size reduced pieces of asphalt roofing shingle material is disposed between two said layers comprising crushed aggregate, and wherein the crushed aggregate of each of the two layers is independently selected from the group consisting of paving stone, gravel, sand, and dirt.

5. The light duty roadway surface of claim 2, in which the size reduced asphalt roofing shingle material comprises reclaimed used asphalt roofing shingles.

6. The light duty roadway surface of claim 5, in which the size reduced asphalt roofing shingle material further comprises new asphalt roofing shingle production waste mixed together with the reclaimed used asphalt roofing shingles.

7. The light duty roadway surface of claim 2, in which layer of size reduced asphalt roofing shingle material further comprises a hydrocarbon distillate selected from the group consisting of asphalt, bitumen, paraffin, and tar.

8. The light duty roadway surface of claim 2, in which said layers are each independently between about one to two inches thick.

9. A method for making a light duty roadway surface, which comprises:

a) providing asphalt roofing shingle material for the construction of the light duty roadway surface by:
   (i) size reducing asphalt roofing shingle material by comminuting or shredding to loose pieces of a sufficient size that can be spread and graded with a roadway grading device;

b) providing loose crushed aggregate of a sufficient size that can be spread and graded with a roadway grading device;

c) applying over a selected portion of a ground surface alternating layers of crushed aggregate and size reduced asphalt roofing shingle material to construct a light duty roadway surface, wherein the loose pieces of asphalt roofing shingle material overlie one another to form a resilient permeable mat.

10. The method of claim 9, in which part (a) further comprises:

(ii) purifying the sized reduced asphalt roofing shingle material by removing foreign ferrous material to produce purified size reduced asphalt roofing shingle material.

11. The method of claim 9, in which part (a) further comprises:

(iii) adding a hydrocarbon distillate selected from the group consisting of asphalt, bitumen, paraffin, and tar to the size reduced asphalt roofing shingle material, for improving adhesion of the individual pieces of asphalt roofing shingle material.

12. The method of claim 9, in which part (c) further comprises:

(i) applying a first base layer of crushed aggregate over the selected portion of the ground surface;

(ii) applying a second cushioning-adhesive layer of size reduced asphalt roofing shingle material substantially over said first base layer; and, (iii) applying a third dressing layer of crushed aggregate substantially over said second cushioning-adhesive layer.

13. The method of claim 12, in which the first, second and third layers are each independently applied using a roadway grading device.

14. The method of claim 12, in which the method further comprises either prior to or after application of the second layer of part (ii):

adding a hydrocarbon distillate selected from the group consisting of asphalt, bitumen, paraffin, and tar to the size reduced asphalt roofing shingle material.

15. The method of claim 12, in which the crushed aggregate of the first and third layers is independently selected from the group consisting of paving stone, gravel, sand, and dirt.

16. The method of claim 12, wherein the size reducing of the asphalt roofing shingle material comprises forming the pieces in elongated flat strips dimensioned to overlie one another to form a mat of overlapping pieces.

17. The method of claim 15, in which the size reduced asphalt roofing shingle material of the second layer is reclaimed used asphalt roofing shingles.

18. The method of claim 15, in which the size reduced asphalt roofing shingle material comprises a mixture of reclaimed used asphalt roofing shingles and asphalt shingle tabs or other new asphalt roofing shingle production wastes.

* * * * *